US005767771A

United States Patent [19]

Lamont

[11] Patent Number: 5,767,771

[45] Date of Patent: Jun. 16, 1998

[54] ELECTRONIC EQUIPMENT THEFT DETERRENT SYSTEM

[75] Inventor: Leonard A. Lamont, Russell, Canada

[73] Assignee: Independent Security Appraisers of Canada, Gloucester, Canada

[21] Appl. No.: 613,155

[22] Filed: Mar. 8, 1996

[51] Int. Cl.[6] ..... G08B 13/14

[52] U.S. Cl. ..... 340/571; 340/522; 340/568

[58] Field of Search ..... 340/571, 568, 340/522

[56] References Cited

U.S. PATENT DOCUMENTS

| | | | |
|---|---|---|---|
| 3,836,901 | 9/1974 | Matto et al. | 340/571 |
| 4,284,983 | 8/1981 | Lent | 340/568 |
| 4,686,514 | 8/1987 | Liptak, Jr. et al. | 340/571 |
| 4,951,249 | 8/1990 | McClung et al. | 364/900 |
| 5,406,261 | 4/1995 | Glenn et al. | 340/571 |

*Primary Examiner*—Glen Swann
*Attorney, Agent, or Firm*—Swabey Ogilvy Renault

[57] ABSTRACT

A theft deterrent system disables one or more components of electronic equipment in response to the unauthorized removal of the electronic equipment. An AC control module is disposed between an AC source and a theft deterrent circuit. The theft deterrent circuit has a first sensor to detect the presence of AC power at the theft deterrent circuit, an alarm circuit having a second sensor to detect unauthorized removal of the electronic equipment, a DC source for supplying power to the alarm circuit and for arming the alarm circuit once the first sensor has detected the absence of AC power to the theft deterrent circuit and a disabling circuit having a high voltage output connected to one or more of the components of the electronic equipment, in order to permanently disable the components when the second sensor detects unauthorized removal of the electronic equipment. A master control unit connected via AC power lines to the AC control module is used for activating and deactivating the AC control module, such that the theft deterrent circuit can be armed remotely from the master control unit when AC power to the theft deterrent circuit is removed.

13 Claims, 8 Drawing Sheets

| AC | DC | Alarm State | Timer | Component's Condition |
|---|---|---|---|---|
| ON | OFF | OFF | OFF | OK |
| OFF | ON | STBY(Armed) | OFF | OK |
| OFF | ON | ON(Activated) | ON | OK |
| OFF | ON | ON | OFF | Disabled |

ELECTRONIC EQUIPMENT THEFT DETERRENT SYSTEM

FIELD OF THE INVENTION

This invention generally relates to security systems and more particularly to a system capable of permanently disabling one or more components of electronic equipment if unauthorized removal is detected.

BACKGROUND OF THE INVENTION

The losses suffered by businesses and individuals caused by computer and electronic equipment theft have become astronomical. For instance, the loss of computer equipment alone in the United States for 1995 was estimated to be over 8 billion dollars. Past attempts to deal with this problem have focused on the prevention of the theft by denying entry to the building where the object is located, making the object physically inaccessible or installation of systems which call attention to unauthorized removal of the object.

In respect of electrical equipment, numerous systems have been designed to prevent unauthorized use and removal of the equipment. The first line of defence against loss is usually a perimeter alarm which is designed to alert law enforcement agencies of unauthorized entry. Unfortunately, the response time of those agencies is usually not sufficient to apprehend the perpetrators. Other systems have been designed which prevent operation of the equipment without some type of code or device being transmitted to the equipment. These devices are divided into two classes, hardware and software.

The hardware systems consist of some type of locking device that prevents use of some part of the equipment essential to the proper operation of the equipment. Examples of this technology in the case of computer equipment are key locks, physical restraints, and access cards that allow the holder to operate the equipment. The main drawback to this approach is that the removal of these devices usually is not difficult and constitutes a minor annoyance to the thief.

The security software systems available constitute a more serious deterrent to the would-be thief in that most people do not have the specialized knowledge required to defeat this type of system. Thieves have overcome this problem by disassembling the equipment and selling the individual components of the equipment, thereby defeating the protection system.

In the case of computer equipment, very often thieves will disassemble the computer to access the memory, CPU and other valuable chips for reselling, as well as the hard drive which can be erased and re-installed in the equipment. Thus, although the data stored on memory is destroyed, the equipment can be resold and new software loaded without too much impact on the hardware.

A more drastic approach is being viewed as a potential theft deterrent system for computer and expensive electronic equipment. This consists in the application of a high voltage to, in the case of computer equipment, the hard disk to permanently disable the hard disk and memory read circuits to render the memory storage devices useless to a thief.

One such system is disclosed in U.S. Pat. No. 5,406,261. In this patent, a power control board is installed in the computer between the power supply and internal subsystems of the computer. This power control board enables the system to control the internal power of the subsystem components of the computer. When armed by the user, the alarm will sound if the computer system is tampered with or attempted to be used when disabled. Highly sensitive data is protected from being compromised by disabling the read circuits from the computer system data storage memory and in special circumstances, the data storage system may be rendered permanently inoperative.

One of the problems associated with the teachings of this patent is that the installation of the power control board requires major refitting of the computer in order to fit the board between the power supply and the components which will be disabled In addition, the user is required to voluntarily activate the alarm each time protection is required. This requires the user to use a remote control device for controlling the arming and disarming of the alarm, such as used in automotive alarms.

Accordingly, a need exists for a theft deterrent system which overcomes the aforementioned problems by being automatically activated once unauthorized removal of the equipment is detected.

It is therefore an object of the present invention to provide a theft deterrent system for electronic equipment such as computers, which can automatically disable one or more components in response to the unauthorized removal of the equipment.

Another object of the present invention is to provide a theft deterrent system which can automatically arm itself if AC power to the equipment is disconnected.

Yet another object of the present invention is to provide a theft deterrent system which, once armed, can disable one or more components of the equipment in response to the unauthorized removal of the equipment.

Yet another object of the present invention is to provide a theft deterrent system which makes use of a tamper-detection circuit to detect tampering of the system.

Yet another object of the present invention is to provide a theft deterrent system in which individual systems can be armed remotely using AC power control modules.

Accordingly, an aspect of the present invention is to provide a theft deterrent circuit for disabling one or more components of electronic equipment in response to the unauthorized removal of the electronic equipment, the theft deterrent circuit comprising a first sensor to detect the presence of AC power at the theft deterrent circuit; an alarm circuit having a second sensor to detect unauthorized removal of the electronic equipment; a DC source for supplying power to the alarm circuit and for arming the alarm circuit once the first sensor has detected the absence of AC power to the theft deterrent circuit; and a disabling circuit having a high voltage output connected to one or more of the components in order to permanently disable the components when the second sensor detects unauthorized removal of the electronic equipment.

Another aspect of the present invention is to provide a theft deterrent system for disabling one or more components of electronic equipment in response to the unauthorized removal of the electronic equipment, comprising, in combination:

a) an AC control module disposed between an AC source and a theft deterrent circuit;

b) said theft deterrent circuit being comprised of:

i) a first sensor to detect the presence of AC power at said theft deterrent circuit;

ii) an alarm circuit having a second sensor to detect unauthorized removal of the electronic equipment;

iii) a DC source for supplying power to said alarm circuit and for arming said alarm circuit once said first sensor has detected the absence of AC power to said theft deterrent circuit; and iv) a disabling circuit having a high voltage output connected to one or more of said components in order to permanently disable the said components when said second sensor detects unauthorized removal of the electronic equipment; and c) a master control unit connected via AC power lines to said AC control module for activating and deactivating said AC control module, such that said theft deterrent circuit can be armed remotely from said master control unit when AC power to said theft deterrent circuit is removed.

BRIEF DESCRIPTION OF THE DRAWINGS

The invention will be better understood by an examination of the following description, together with the accompanying drawings, in which.

DESCRIPTION OF THE PREFERRED EMBODIMENT

Figures 1, 3:
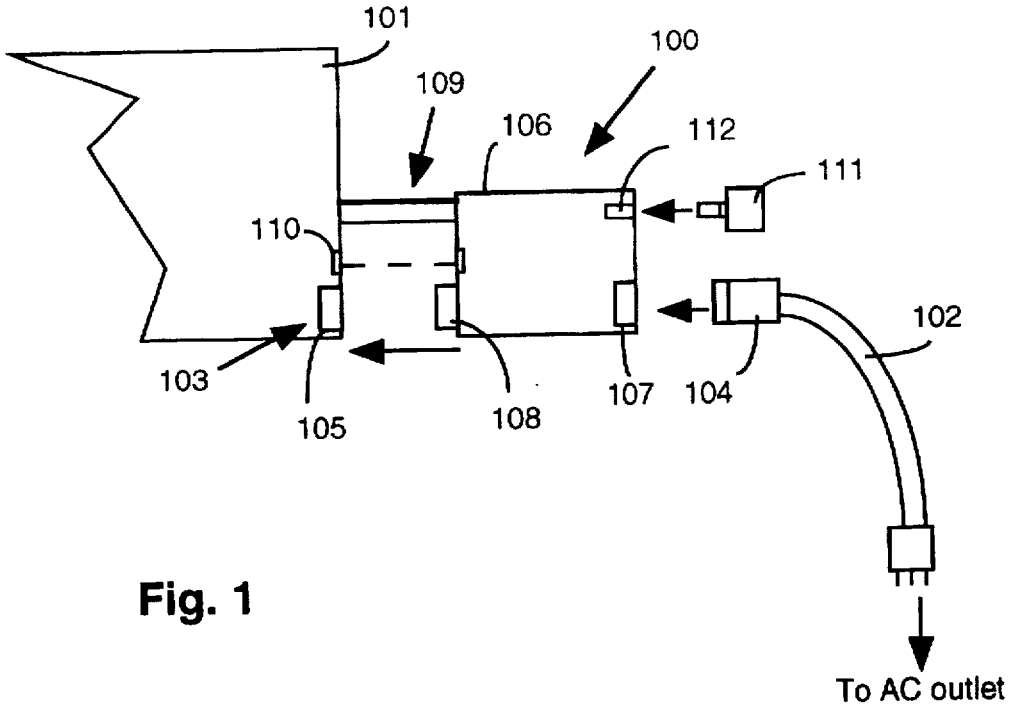
FIG. 1 is a block diagram illustrating the installation of the theft deterrent circuit of the present invention.
FIG. 3 is a table illustrating the varying states of the theft deterrent circuit of the present invention.

Referring now to FIG. 1, we have shown a diagram illustrating the theft deterrent system of the present invention. In its most basic form, the theft deterrent system is provided as part of an add-on board or attachment box 100 for attachment to a computer or other electronic equipment 101 meant to be protected. Preferably, the box 100 is installed and secured to the back of the computer or electronic equipment 101 between the power extension cord 102 and power extension inlet 103.

Since most of today's computers and electronic equipment are provided with detachable power extension cords having standard size female and male plug-in connections 104 and 105 respectively, the protector box 106 can similarly be provided with male and female power connections 107 and 108 respectively, such that it can fit between the standard power extension cord 102 and the back of the computer or electronic equipment requiring protection. The theft deterrent protector box 106 is provided with one or more output lines 109 adapted to supply a high voltage to disable one or more components within the computer or piece of equipment 101, if the equipment is stolen. A tamper detection sensor 110 is provided to detect any attempt made for removal of the protector box 106 from the back of the equipment. Such an attempt would automatically trigger the alarm and disable the components which have been connected to the output lines 109.

A by-pass key 111 may be provided for insertion into a slot 112 of protector box 106 to temporarily disable the alarm and disabling circuit to permit the transport and maintenance of the equipment by an authorized user. Key 111 can consist of a passive or active circuit, which when connected to slot 112 provides the protector box 106 with a unique code to indicate that an authorized user requires access to the equipment. A key may be constructed using four miniature female jacks that are connected so that two jacks interrupt the power line to the alarm circuit and the other two jacks connect the power to the disabling circuit in case of tampering. The actual key would consist of four male plugs wired in such a way that when inserted into the female jacks the deactivation of the system is accomplished.

Figure 2:
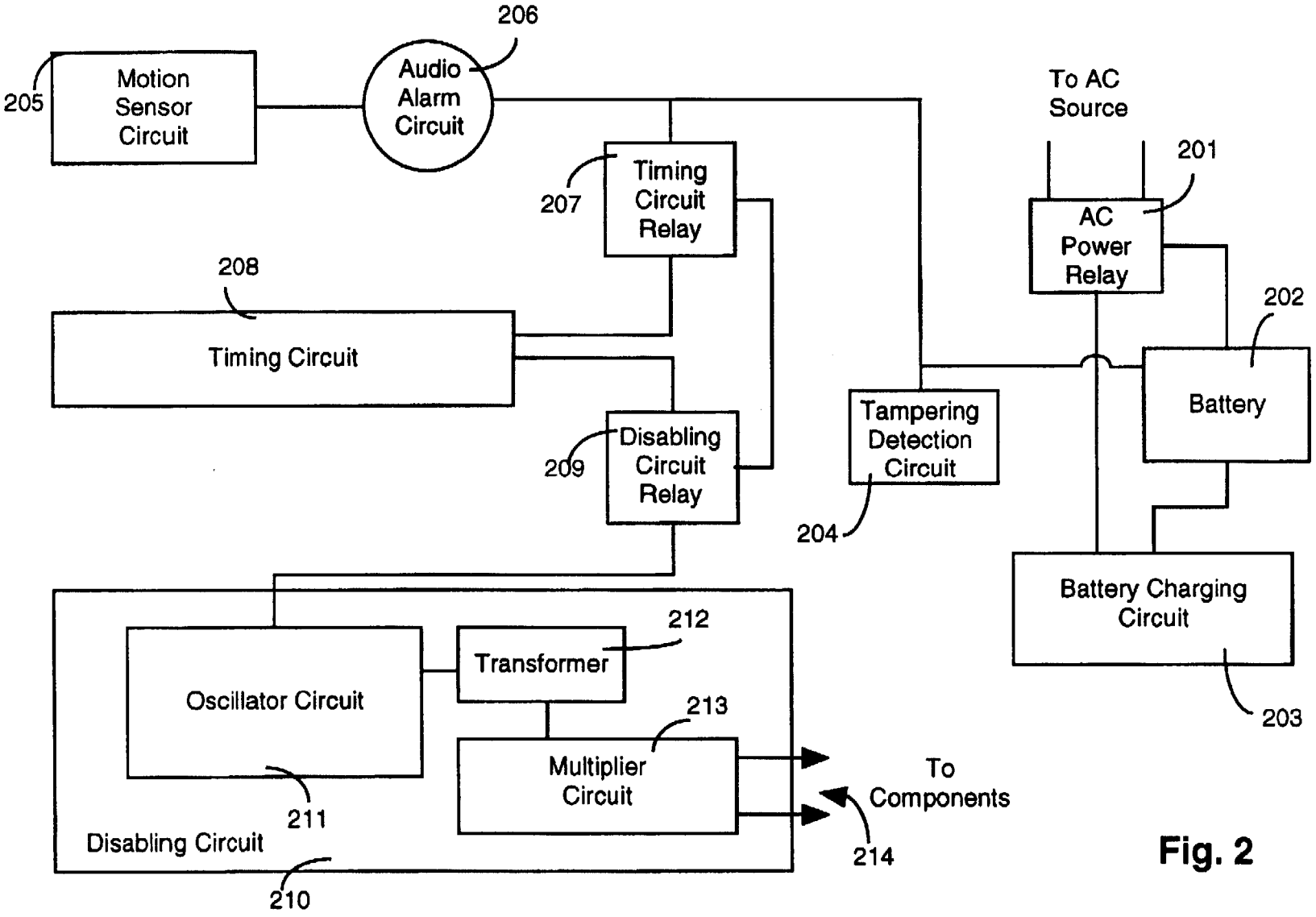
FIG. 2 is a block diagram of the theft deterrent circuit shown in FIG. 1.

Referring now to FIG. 2, we have shown a block diagram of the circuitry used in the protector box 106 shown in FIG. 1. The protector box 106 has three main functions. First, it detects presence of AC power to the equipment, second, it provides DC power to and arms the alarm circuitry if AC power is removed and third, it disables one or more components of the computer if the alarm is set off.

With reference to FIG. 2, the protector box 106 circuitry is provided with an AC power relay 201 connected between the AC source and a battery 202 and battery charging circuit 203. If the power cord is removed from the equipment or disconnected from an AC outlet, the AC power relay 201 enables battery 202 to provide power to the alarm circuitry. If this condition is detected, the alarm is armed and placed in a standby mode. When connected to an AC outlet, the AC power relay 201 enables battery charging circuit 203 to keep battery 202 at full charge.

A tampering detection circuit 204 disposed between the power source and alarm circuitry is used to detect tampering of the equipment, such as any attempt to remove the protector box 106 shown in FIG. 1 from the back of the computer or equipment. Tampering detection circuit 204 can consist of a suitable sensor, such as a magnetic relay, to permit the detection that the box is being tampered with.

If AC power is removed from the computer or equipment, battery 202 provides power to the motion sensor circuit 205 and audio alarm circuit 206, thus arming the alarm circuitry. Once armed, any motion detected by sensor circuit 205 will trigger audio alarm 206 as well as timing circuit relay 207. The audio alarm 206 can consist of an audible alarm generator, such as a piezo-electric buzzer. When the timing circuit relay 207 is triggered, timing circuit 208 is enabled and the timer of the timing circuit activated. The timer is adjustable such that a delay of between 15 minutes and 16 hours can be provided before the disabling circuit is activated. At the end of the timing cycle, the timing circuit 208 activates the disabling circuit relay 209 which provides power to disabling circuit 210. Disabling circuit 210 is comprised of an oscillator circuit 211, transformer 212 and voltage multiplier circuit 213. These three components enable the disabling circuit to increase the voltage from a standard 9 volt battery to a high output voltage, such as 2 KV, thus providing sufficient voltage to permanently disable any components to which output leads 214 are connected.

The alarm circuitry can be designed such that if motion sensor circuit 205 no longer detects movement, the timing circuit 208 is put on hold to prevent the disabling circuit from being inadvertently triggered by an authorized user. The means by which the timing circuit can be placed on hold can of course be selected by the user prior to installation of the protector box to the equipment being protected.

With reference to FIG. 3, we can show the various states which can exist with the theft deterrent circuit of the present invention. When AC power is available, the battery or DC power is off, the alarm is in the off state, the timer is also off and the components are OK. As soon as the AC power is turned off, DC power is supplied to the circuitry thus placing the alarm on stand-by or in an armed state. At that point, the timer is still off and the components are still OK. However, if the alarm state changes to an on or triggered state, i.e. the alarm is activated by detection of motion by motion sensor circuit 205 of FIG. 2, the timer is turned on and the timing circuit is initiated. The components conditions remain okay until the timing cycle ends at which time, a high voltage is sent to the specified components to disable them.

Figure 4:
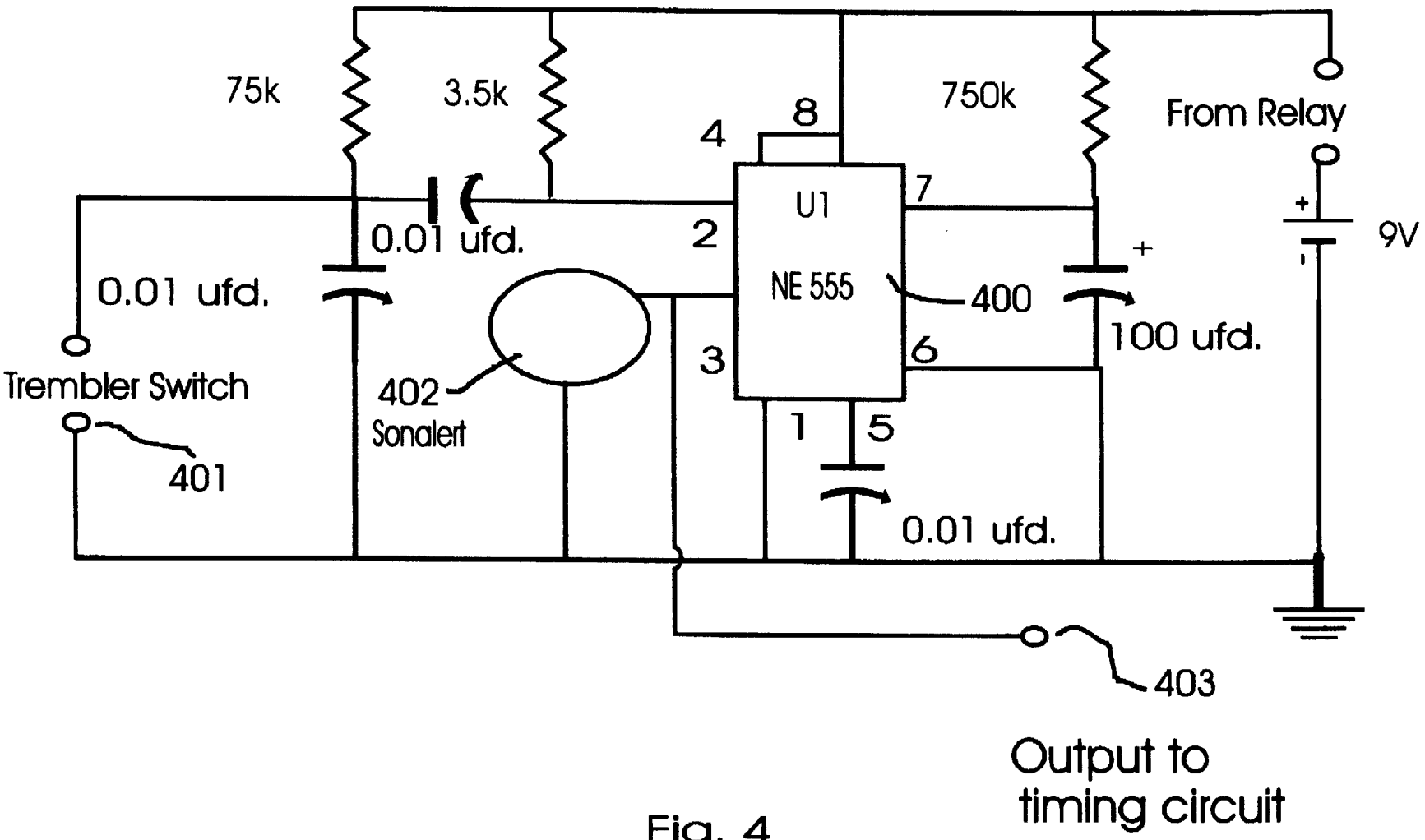
FIG. 4 is a schematic of the alarm triggering circuit.
Figure 5:
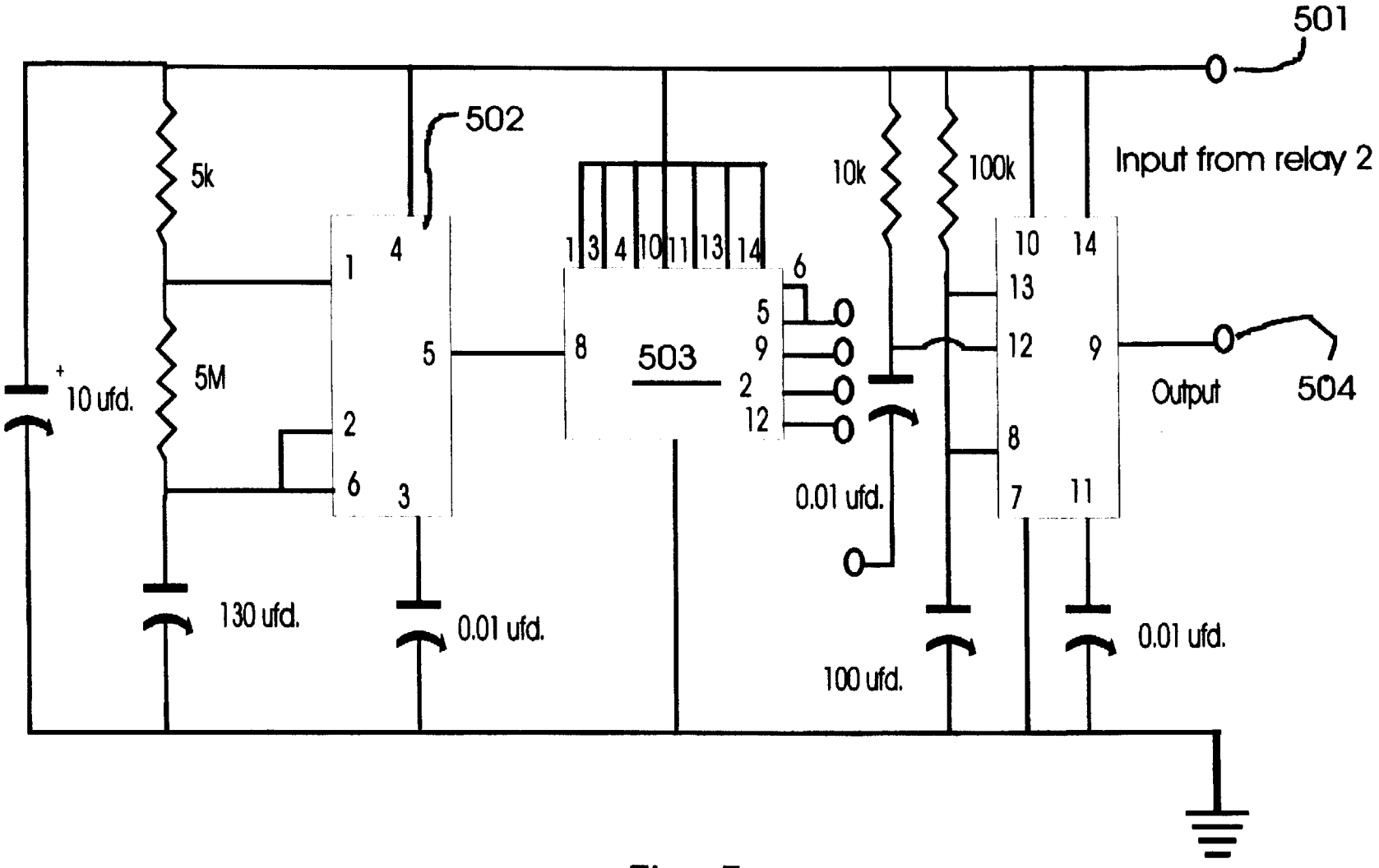
FIG. 5 is a schematic of the timing circuit of FIG. 2.
Figure 6:
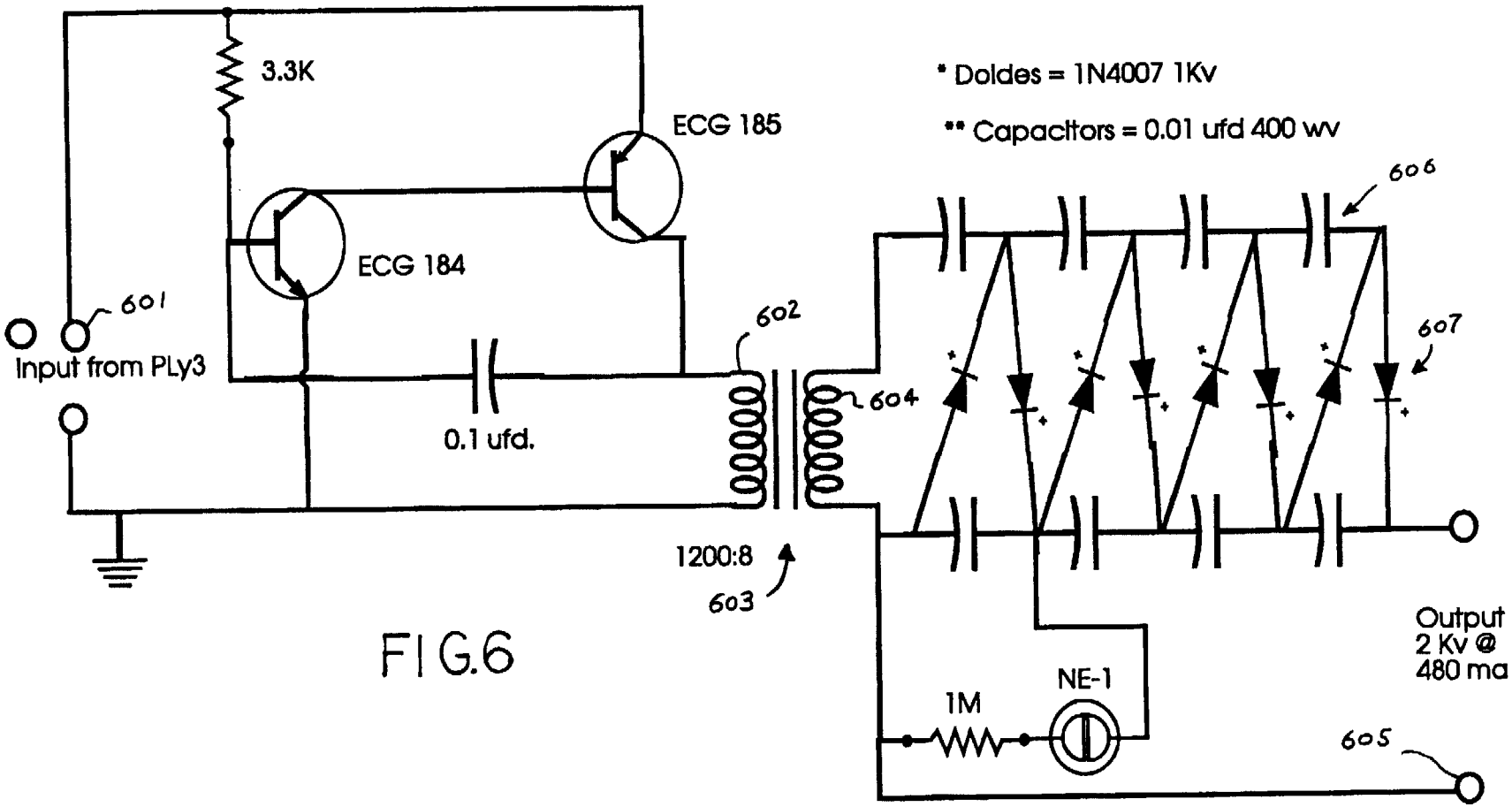
FIG. 6 is a schematic of the disabling circuit of FIG. 2.
Figure 7A:
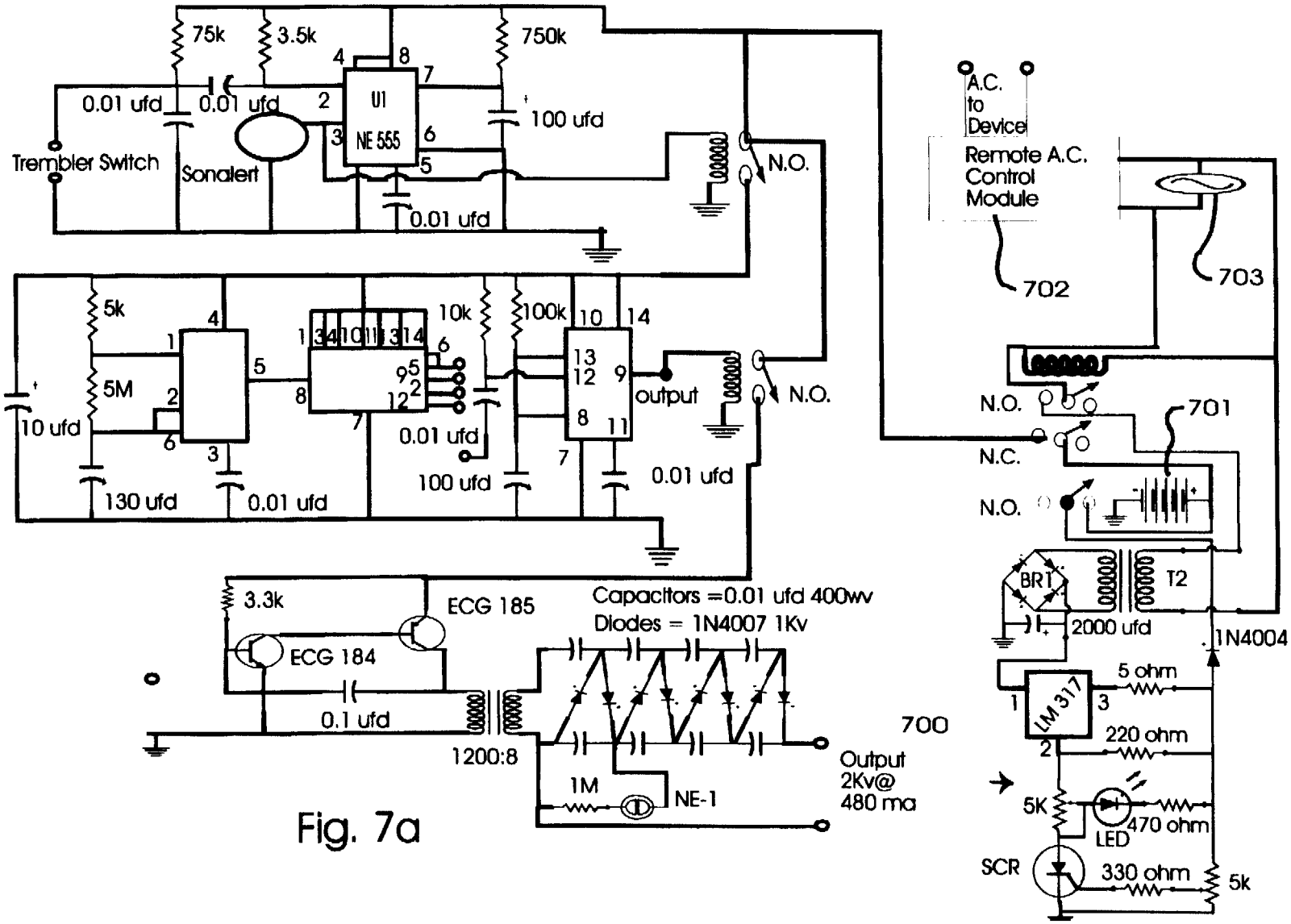
FIGS. 7*a* and 7*b* are an overall schematics of the theft deterrent system according to a first and second embodiment of the invention.
Figure 7B:
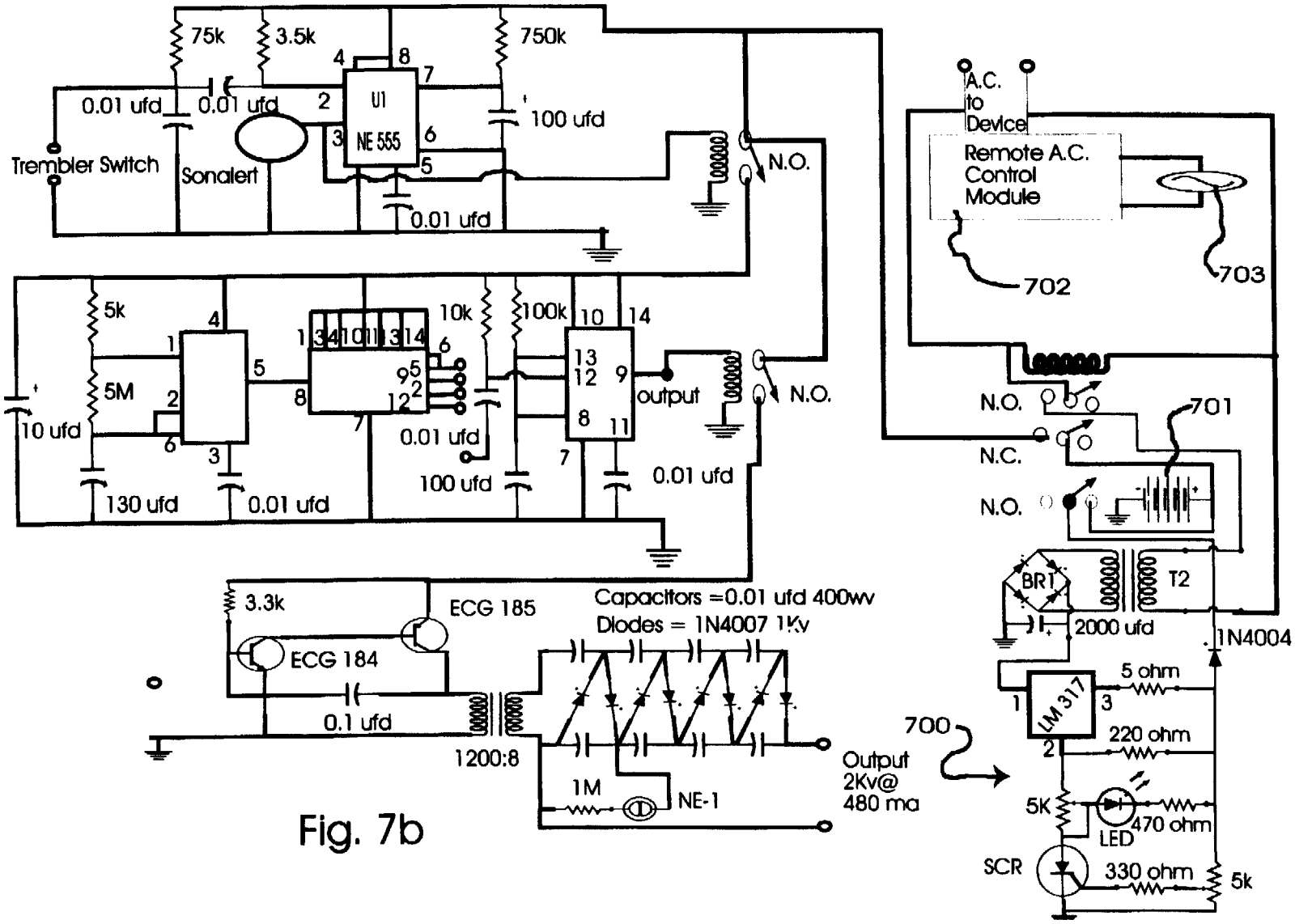

Referring now to FIG. 4, we have shown a schematic diagram of the motion sensor and audio alarm circuits 205 and 206 respectively shown in FIG. 2. When the AC power relay 201 shown in FIG. 2 is closed, 9 volts from battery 202 is placed across timing chip 400 thus arming the alarm circuit. The alarm circuit comprises a trembler switch 401 and an audio alarm 402. When timing chip 400 is placed on stand-by and trembler switch 401 is triggered, output pin 3 of timing chip 400 goes high thereby triggering the audio alarm 402 and simultaneously taking output 403 high as well. When output 403 of the alarm circuit of FIG. 4 goes high, the timing circuit relay 207 is triggered and input 501 of timing circuit 208 (FIG. 5) goes high as well. When input 501 goes high, pulse generator chip 502 generates a pulse at predetermined time intervals which are counted by a 35 MHz decode and binary counter/latches chip 503. The counter 503 is set upon installation at a predetermined timing cycle length. When the timing cycle has ended, output 504 goes high thus triggering disabling circuit relay 209. When triggered, the output of disabling circuit relay 209 goes high and thus activates the disabling circuit, shown in FIG. 6 by taking input 601 high as well.

When the input to the oscillator circuit goes high, a pulsed voltage is placed across the first winding 602 of transformer 603. The corresponding pulse output of the second winding 604 of transformer 603 charges the capacitors of the voltage multiplier circuit. The capacitors are charged to a high enough voltage to disable any component connected to the output 605. The combination of capacitors 606 and diodes 607 enables a 9 volt voltage at the input of the oscillator circuit to be boosted to an output of 2 KV at output 605. Connection of the disabling circuit to the individual components to be affected can be accomplished in a number of ways. In the case of CPUs the connections may be accomplished by using a Plastic Leaded Chip Carrier (PLCC) carrier in inverted position that is connected to the CPU and wires connected to the pins which contact the clock inputs. Various plugs could also be used to connect the disabling circuit to those devices that require this type of connection. Lastly direct connections can be made to those devices which are best served by this type of connection.

A full schematic of the theft deterrent circuit is shown in FIG. *7a*. The schematic shows a diode bridge and battery charging circuit 700 which is used to recharge battery 701 when the circuit is connected to AC power. As will be described further below, the theft deterrent circuit of the present invention can also be used with remote AC control modules 702 such that individual computers or electronic equipment connected to AC power 703 via a remote AC control module 702 can be controlled remotely from a master control unit 801 such as shown in FIG. 8.

In the embodiment of FIG. *7b*, the alarm circuitry is connected directly to the AC source, whereas the equipment requiring protection is connected via remote control module 702. Thus, in this configuration, the alarm remains in a non-standby mode or disarmed even with the power to the equipment turned off. If an attempt is made to remove the equipment by disconnecting the equipment's extension cord, then the alarm circuit goes to the standby mode (armed state). In the preferred embodiment of FIG. *7a*, the AC control module 702 is placed between AC power source 703 and the alarm circuit, such that several computers can be armed remotely simultaneously.

Figure 8:
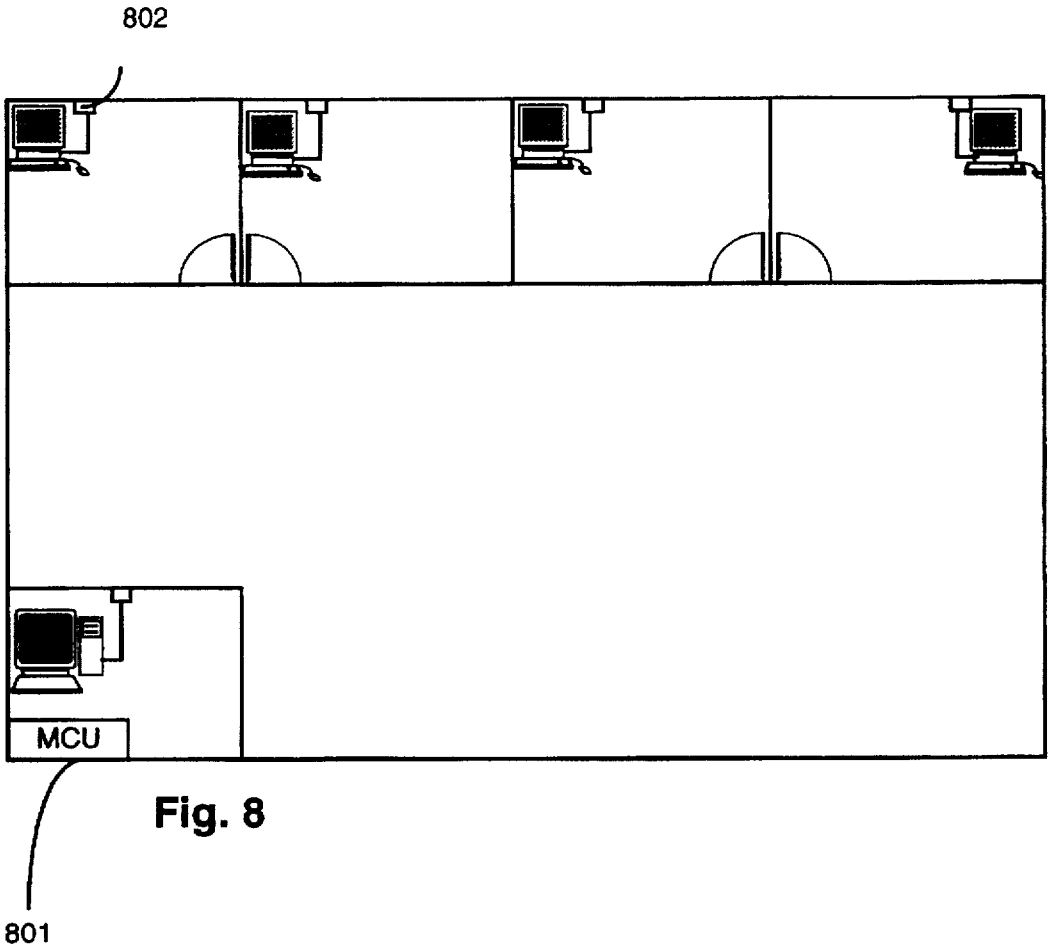
FIG. 8 is a diagram illustrating the use of the theft deterrent system according to another embodiment of the present invention.

In the embodiment of FIG. 8, a number of computers each having and making use of the theft deterrent system of the present invention, receive AC power via a remote AC control module 802. That is, each computer is connected to an AC outlet via the AC control module. With this arrangement, power to individual computers connected to a remote AC control module 802 can be controlled by means of a master control unit 801. Remote control systems such as described here are manufactured by Powerhouse available from X-10 Home Controls, Inc., 1200 Aerowood Drive, Unit 20, Mississauga, Ontario, Canada, L4W 2S7. Master control unit 801 can be used to turn on and off power to each individual computer connected to a remote control module. This is accomplished using an FM or DC signal superimposed on the AC signal on the AC power line connecting each control module to the master control unit. Thus, if AC power to a computer is turned off the theft deterrent system of the present invention is placed in an armed state. This arrangement can be particularly useful in situations wherein theft of electronic equipment is a common occurrence, such as in rooms that are accessible to the public, for example school class rooms, etc.

Variations of the particular embodiment herewith described will be obvious to one skilled in the art, and accordingly, the embodiment is to be taken as illustrative rather than limiting, the true scope of the invention being set out in the appended claims.

I claim:

1. A theft deterrent system for disabling one or more components of electronic equipment in response to the unauthorized removal of the electronic equipment, the theft deterrent circuit comprising, in combination:

(a) an AC control module having an input connected to an AC source and an output connected to said electronic equipment;

(b) a theft deterrent circuit comprised of:

(i) an AC power relay to detect the presence or absence of AC power to said electronic equipment;

(ii) an alarm circuit having a sensor to detect unauthorized removal of the electronic equipment;

(iii) a DC source for supplying power to said alarm circuit, said DC source being enabled to supply power to said alarm circuit and place said alarm circuit in a stand-by mode once said AC power relay has detected the absence of AC power to said electronic equipment; and (iv) a disabling circuit having a high voltage output connected to one or more of said components in order to permanently disable the said components, when said sensor detects unauthorized removal of the electronic equipment;

(c) a master control unit connected via AC power lines to said AC control module for activating and deactivating said AC control module and thereby activating and deactivating AC power to said electronic equipment.

2. A theft deterrent system as defined in claim 1, wherein said AC power relay is connected at the output of said AC control module such that said alarm circuit is placed on a stand-by mode once absence of AC power is detected at the output of said AC control module.

3. A theft deterrent system as defined in claim 2, wherein said alarm circuit comprises a motion detector and an audible alarm generator, said audible alarm generator being triggered when said motion detector detects movement of the electronic equipment.

4. A theft deterrent system as defined in claim 3, further comprising a timing circuit connected between said alarm circuit and disabling circuit, such that when said motion detector is triggered, a timing cycle in said timing circuit is started and said disabling circuit is not activated until a predetermined time measured by the timing circuit has elapsed.

5. A theft deterrent system as defined in claim 4, wherein said disabling circuit comprises an oscillator circuit connected to a multiplier circuit via a transformer, such that a low voltage at the input of the oscillator circuit can be amplified to a high voltage at the output of the multiplier circuit.

6. A theft deterrent system as defined in claim 5, wherein said master control unit communicates with said AC control module over said AC power lines, using an FM signal superimposed over AC.

7. A theft deterrent system as defined in claim 6, wherein said electronic equipment comprises a desktop computer.

8. A theft deterrent system as defined in claim 1, wherein said AC power relay is connected at the input of said AC control module such that said alarm circuit is placed on a stand-by mode once absence of AC power is detected at the input of said AC control module.

9. A theft deterrent system as defined in claim 8, wherein said alarm circuit comprises a motion detector and an audible alarm generator, said audible alarm generator being triggered when said motion detector detects movement of the electronic equipment.

10. A theft deterrent system as defined in claim 9, further comprising a timing circuit connected between said alarm circuit and disabling circuit, such that when said motion detector is triggered, a timing cycle in said timing circuit is started and said disabling circuit is not activated until a predetermined time measured by the timing circuit has elapsed.

11. A theft deterrent system as defined in claim 10, wherein said disabling circuit comprises an oscillator circuit connected to a multiplier circuit via a transformer, such that a low voltage at the input of the oscillator circuit can be amplified to a high voltage at the output of the multiplier circuit.

12. A theft deterrent system as defined in claim 11, wherein said master control unit communicates with said AC control module over said AC power lines, using an FM signal superimposed over AC.

13. A theft deterrent system as defined in claim 12, wherein said electronic equipment comprises a desktop computer.

* * * * *